United States Patent [19]

Hickman

[11] 3,976,374

[45] Aug. 24, 1976

[54] ELIMINATION OF REDUNDANT IMAGE

[75] Inventor: Robert George Hickman, Burghlere, near Newbury, England

[73] Assignee: Rank Xerox Ltd., London, England

[22] Filed: Mar. 11, 1975

[21] Appl. No.: 557,422

[30] Foreign Application Priority Data

Apr. 18, 1974 United Kingdom ..... 17063/74

[52] U.S. Cl. ..... 355/14; 271/256; 355/67

[51] Int. Cl.[2] ..... G03G 15/00

[58] Field of Search ..... 355/14, 3 R, 17, 67; 271/256; 118/637

[56] References Cited

UNITED STATES PATENTS

| | | | |
|---|---|---|---|
| 3,700,327 | 10/1972 | Murgas et al. | 355/14 |
| 3,790,273 | 2/1974 | Tanaka | 355/16 |
| 3,819,261 | 6/1974 | Ogawa | 355/14 |
| 3,826,569 | 7/1974 | Sakamaki | 355/14 |

*Primary Examiner*—R L Moses

[57] ABSTRACT

A copying machine comprises an electrostatographic surface, means to set the selected number of copies to be made by the apparatus, means to drive the surface a plurality of times successively from a charging station through an exposure station to a developing station, and means to render at least one of said stations inoperative for a period at the start of the copying run in order to allow all parts of the apparatus to reach operative condition.

3 Claims, 2 Drawing Figures

40
42
44
45
20
C
D
B
52
66
71
51
55
25
A
27
LMP-1
E
22
LMP
24
60
23
65
61

ELIMINATION OF REDUNDANT IMAGE

This invention relates to copying machines.

In an automatic copying machine such as described in British patent specification No. 1122622, an electrostatographic surface in the form of a xerographic drum rotates through a plurality of processing stations, a charging station at which a uniform charge is applied to the surface of the drum, an exposure station at which the uniform charged surface is selectively discharged in accordance with the image to be reproduced, a developing station at which two-component developer material is cascaded over the drum surface to develop the latent electrostatic image, a transfer station at which the developed image is transferred to a sheet of support material and a cleaning station at which surplus developer material is cleaned from the surface of the drum. The drum then continues to rotate through the processing stations another time. In the copying machine described in the above British patent specification, three separate images are disposed on the surface of a drum during a copying run, so that while one image is being formed at the exposure station, another is passing from the developing station to the transfer station, and the surplus developer material of a third is being cleaned from the drum after transfer.

Once a copying run has got under way, all the above processes work in sequence without trouble, but difficulties are encountered at the beginning of a copying run when some of the mechanically moving parts have not reached their required speed. It is extremely important that the various parts of the machine should move in synchronism, in order that an accurate reproduction of the document being reproduced can be made on the sheet of support material. It has been found that the sheet feed apparatus does not reach the required speed in time to feed a sheet through the drum to receive the first image in a copying run, and accordingly the feeding of a sheet is inhibited. This means that the image is formed and developed, and all the developer material deposited on the xerographic drum passes to the cleaning station, causing wastage of developer material and creation of dust clouds at the cleaning station which may escape to contaminate other parts of the apparatus.

According to the present invention, there is provided a copying machine comprising an electrostatographic surface, means to set the selected number of copies to be made by the apparatus, means to drive the plate a plurality of times successively from a charging station through an exposure station to a developing station, and means to render at least one of said stations inoperative for a period at the start of the copying run in order to allow all parts of the apparatus to reach operative conditions.

An example of the invention will now be described with reference to the accompanying drawings in which.

Figure 1:
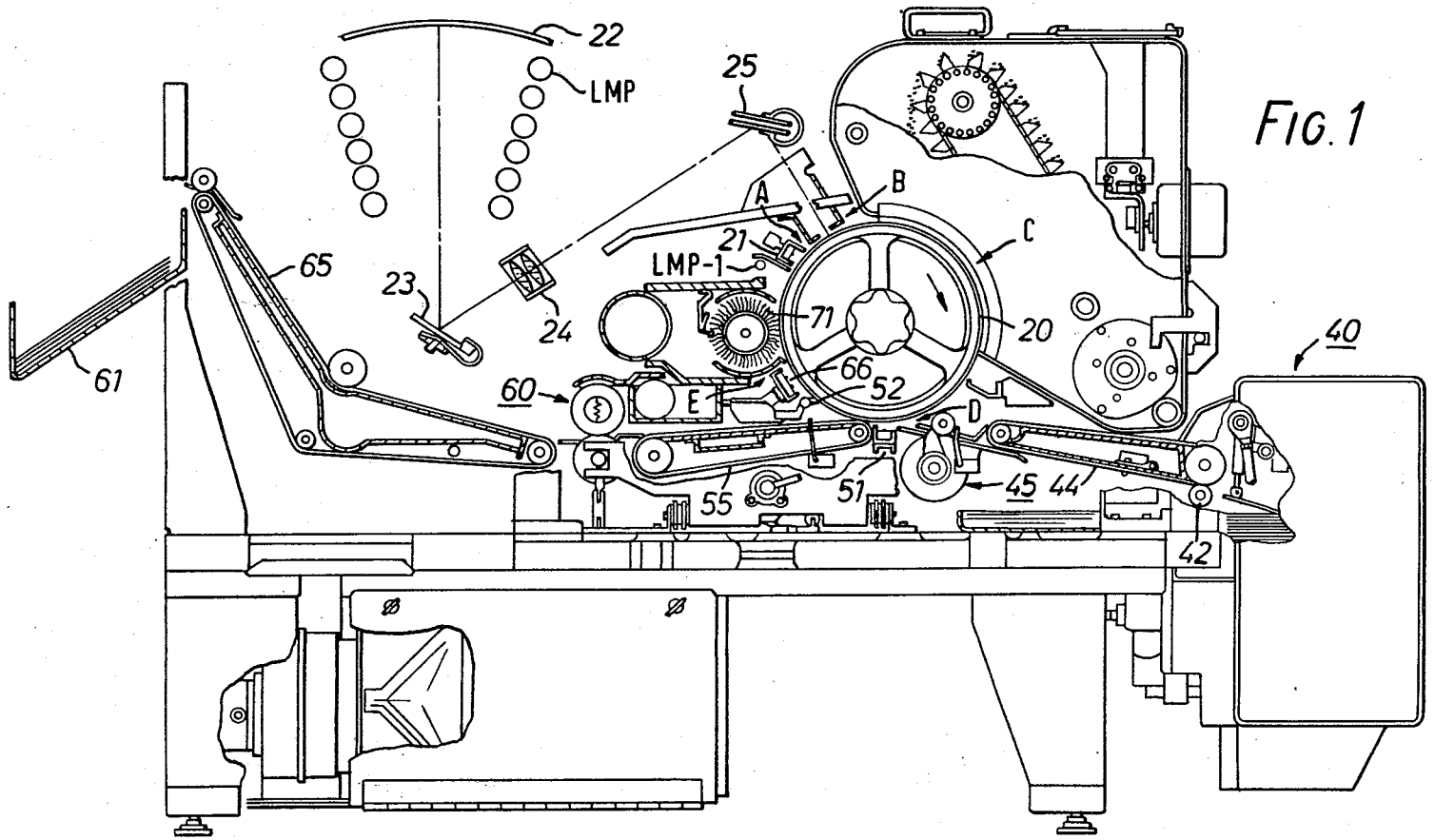
FIG. 1 is a diagrammatic layout of a copying machine as described in British patent specification No. 1122622.
Figure 2:
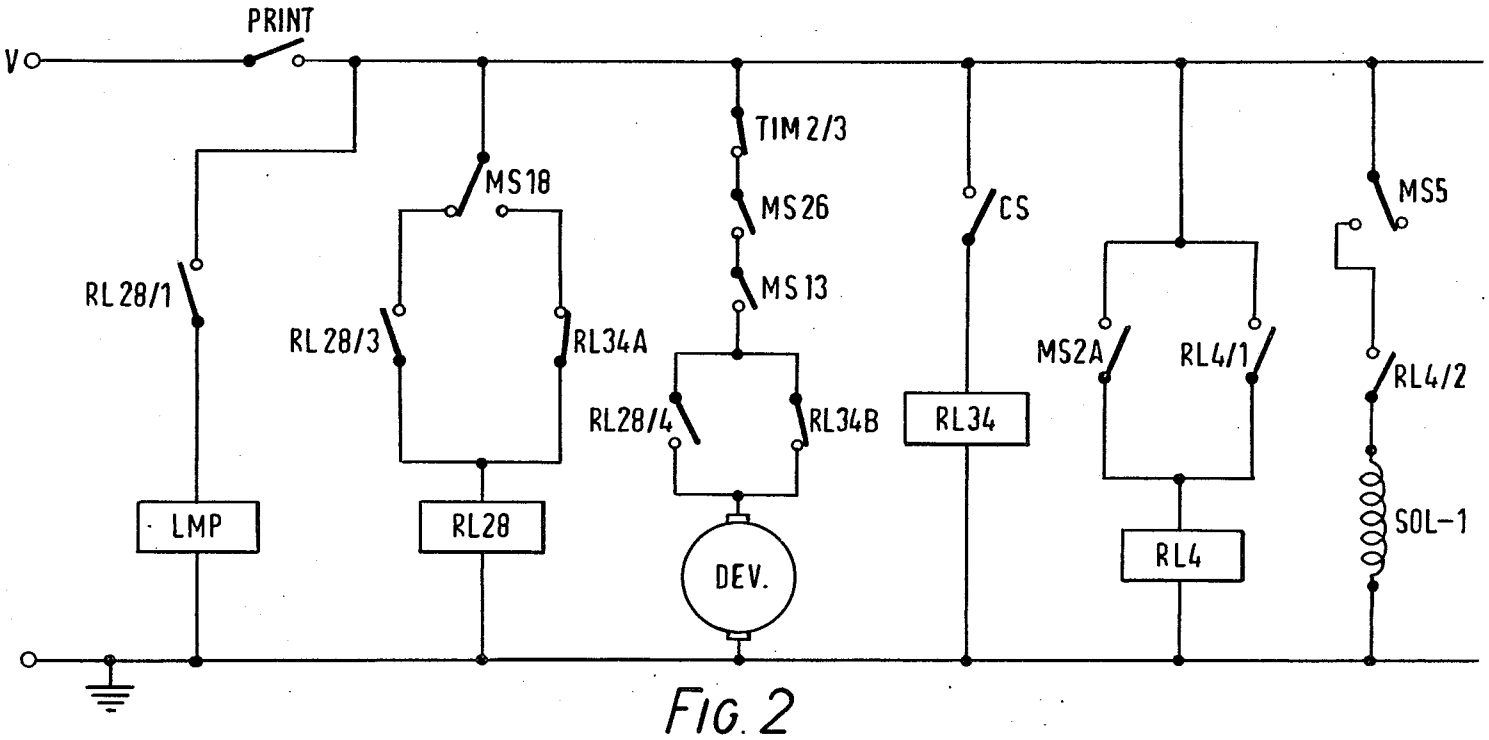
FIG. 2 is a circuit diagram for controlling the apparatus of FIG. 1 according to the present invention.

In FIG. 1, an electrostatographic surface in the form of a xerographic drum 20 rotates in turn through a charging station A at which a uniform charge is applied by means of a corona discharge device 21 through an exposure station B at which a flowing light image is projected by means of an oscillating plane mirror 23, a fixed lens 24 and a fixed plane mirror 25 from a document placed face downwards on a curved platen 22 and illuminated by lamps LMP. The flowing light image creates a latent electrostatic image from the uniform charge applied by the device 21 and this is developed at the developing station C by two component developer material which is caused to cascade over the drum surface. The developed image on the drum passes to the transfer station D at the bottom of the drum at which a sheet of paper fed on a supply 40 by a conveyor 44 and drive roller 45 is fed into contact with the drum surface and moves the same peripheral speed. Transfer of the toner powder is achieved by a corona discharge device 51, after which the paper is stripped from the drum by a puffer 52 and transported by a further conveyor 55 to a fuser 60 and thence by a conveyor 65 to an output tray 61. The drum surface, after leaving the transfer station passes a cleaning station E which includes a corona precleaning device 66, a rotating brush 71 and a discharge lamp LMP 1. The drum then passes through the processing stations a second time.

It is important that the moving components of the apparatus should move in synchronism with the drum so that the flowing image of the document on the platen 22 is accurately reproduced in the latent electrostatic image at the exposure station B, and the developed image is accurately transferred to the sheet of paper at the transfer station D. The drive to the paper feeding device 40 and the conveyor 42, which is common with that of the developing station C, takes a little time to reach the required speed, whereas the apparatus of FIG. 1 is designed to start charging the drum and then to expose the charged drum to the first flowing image of the document on the platen 22 immediately a copying run is started. If paper is fed into contact with the drum at the transfer station D to receive the first few direct images, the first few copies of the document will not be acceptable and additional copies will have to be made in a further copying run in order to make up the deficiency. Previously, the solution to this problem has been to prevent sheets being fed into contact with the drum for the first one or more copies until the drive to the paper feed system has reached the required speed. Although this prevents wastage of paper and the provision of the correct number of properly reproduced documents, since the number of copies is counted from the number of sheets fed to the drum, it results in the first image or images formed and developed on the drum passing to the drum cleaning station without transfer so that the drum cleaning station is required to remove all the toner deposited on the drum which may overload it and cause toner particles to escape to contaminate other parts of the apparatus. The present apparatus overcomes this problem by preventing operation of one of the charging, exposure and developing stations so that a large amount of developer does not reach the cleaning station. Although it is a possible solution to deactivate the charging station A during the time at which the first copy or copies would be made in a copying run, it has been found that corona discharge devices take a few milliseconds to reach their operating conditions after switching on so that the first copy to be made after an inoperative period of the charging station may be affected by a non-uniformly charged drum reaching the exposure station. In view of the large number of moving parts in the developing station, it is difficult to switch off development entirely and to bring it back to operative conditions instantaneously between the passage of two images and to achieve uniform development of the second of the images.

The apparatus is therefore arranged to delay operation of the exposure station for a sufficient time that a sheet of paper will be properly fed to the transfer station to receive the image after development. During this delay period, the drum is charged uniformly by the corona discharge device but the developer material does not deposit on the uniformly charged drum except around a small peripheral region because the development station is not able to develop large areas of uniform charge, but only deposits toner particles in areas of high potential gradient. The cleaning station is well able to cope with this small amount of developer which reaches it because there is no transfer at the transfer station. After the delay period, the lamps LMP are switched on by relay RL 28 and reach their operative condition without substantial delay so that a faithful reproduction of the document can be made from the first electrostatic latent image to be formed and this image after development is transferred onto the first sheet of paper to be fed from the paper supply to the transfer station.

During a machine cycle, the microswitches MS 18, MS 5 and MS 2 are actuated sequentially. At the end of a previous copying run, the machine stops at a point in its cycle after actuation of microswitches MS 18 and MS 5, and before actuation of MS 2. When the print button is depressed to start a new copying run, the machine first actuates MS 2 and its contact MS 2A closes to energize relay RL 4 which is then held energized by its contact RL 4/1. Relay RL 4/2 also closes, so that when the machine eventually actuates MS 5, the paper feed solonoid SOL-1 is energized. This solonoid SOL-1 actuates the paper feeder. There is a delay of nearly one cycle in the energization of SOL-1 because it is necessary for MS 2 and MS 5 to be energized in sequence before SOL-1 is energized. Thus, the paper feeders are not energized during the first machine cycle after the print button depressed.

A similar delay occurs in the energization of the lamps LMP under the control of the relay contact RL 28/1. At the start of the copying run, microswitch MS 18 is deactuated so that relay RL 28 is de-energized, and does not become energized until MS 18 is actuated nearly one cycle after the depression of the print button. Relay RL 28 is then held energized by its hold contact RL 28/3 and through the normally closed contact RL 34A, irrespective of the position of microswitch 18. Thus, the lamps remain energized during the copying run.

Power to the developer tank is supplied immediately the print button is depressed through the normally closed contacts TIM 2/3, interlock microswitches MS 26 and MS 13 and the parallel arms containing normally open contact RL 28/4 and normally closed contact RL 34B. The power is applied to the developer tank initially through RL 34B, and then through that contact together with RL 28/4 after relay RL 28 has been energized after the delay period mentioned above.

The end of the copying run is marked by coincidence between the number of copies set to be made in the machine and the number of sheets fed to the xerographic drum. Coincidence between these numbers causes the coincidence switch CS to be closed, energizing relay RL 34 and opening its contact RL 34A and RL 34B. Power to the developer motor and the exposure lamps LMP continues to be applied through the appropriate contact of relay RL 28, until microswitch MS 18 is next actuated. Actuation of MS 18 when RL 34A is open causes relay RL 28 to be de-energized, thus breaking the circuit to the lamps LMP, and to the developer motor. There is no need for contact RL 34B to be a heavy duty contact, since no switching action takes place on its actuation, the application of power to the developer motor being made by the print button, and the withdrawal of power to the motor being made on opening of contact RL 28/4.

The above arrangement limits the delay after the starting of the copying run for the lamps and the paper feed solonoid to be energized to just under one copying cycle, but a longer period can be achieved by inserting a suitable time delay in the power supply to relay 28.

With the arrangement described above, the exposure station and the paper feeder are both rendered inoperative for a period sufficient for the paper transport to reach the required speed for synchronism with the xerographic drum. When the components are rendered operative after the end of the delay period, all the processes of the copying cycle can proceed in exact synchronism.

It is to be understood that the description herein of a preferred embodiment, according to the invention, is set forth as an example thereof and is not to be construed or interpreted as a limitation on the claims which follow and define the invention.

What is claimed is:

1. A copying machine comprising: means to set the selected number of copies to be made by the apparatus, means to drive an electrostatographic surface a plurality of times successively from a charging station through an exposure station to a developing station, means to render at least one of said stations inoperative for a period at the start of the copying run in order to allow all parts of the apparatus to reach operative conditions, a plurality of microswitches, and means to actuate each microswitch in turn during each copying cycle of the machine, said means to render one of said stations inoperative including one of said microswitches, said period ending when said one microswitch is first actuated during a copying run.

2. A copying machine as claimed in claim 1 whose exposure station comprises an exposure lamp, the means for rendering one of said stations inoperative being connected to prevent energization of said lamp for said period.

3. A copying machine as claimed in claim 1 wherein said one microswitch is arranged relative to the microswitch actuating means so that it is actuated nearly one copying cycle after the start of the copying run.

* * * * *